US005295855A

United States Patent [19]

Walz

[11] Patent Number: 5,295,855

[45] Date of Patent: Mar. 22, 1994

[54] POSITIVE CONNECTION LATCH

[75] Inventor: Gerald C. Walz, Grass Lake, Mich.

[73] Assignee: Electro-Wire Products, Inc., Dearborn, Mich.

[21] Appl. No.: 61,457

[22] Filed: May 17, 1993

[51] Int. Cl.[5] ..... H01R 13/627

[52] U.S. Cl. ..... 439/354; 439/357; 285/319

[58] Field of Search ..... 439/350, 351, 353, 354, 439/357, 358, 192, 194; 285/921, 319; 24/575, 615, 616; 403/326, 321

[56] References Cited

U.S. PATENT DOCUMENTS

| | | | |
|---|---|---|---|
| 3,721,939 | 3/1973 | Paugh | 439/354 |
| 4,261,628 | 4/1981 | Gallagher et al. | 439/354 |
| 4,370,013 | 1/1983 | Niitsu et al. | 339/82 |
| 4,532,682 | 8/1985 | Murao | 24/616 |
| 4,669,755 | 6/1987 | Harris et al. | 285/319 |
| 4,925,398 | 5/1990 | Samejima et al. | 439/357 |
| 4,950,179 | 8/1990 | Takenouchi et al. | 439/352 |
| 4,975,075 | 12/1990 | Jinno et al. | 439/353 |
| 4,986,766 | 1/1991 | Leonard et al. | 439/352 |
| 5,163,848 | 11/1992 | Maeda et al. | 439/489 |

*Primary Examiner*—Gary F. Paumen
*Assistant Examiner*—Hien D. Vu
*Attorney, Agent, or Firm*—Krass & Young

[57] ABSTRACT

A positive connector latch to be used on a connector resiliently engagable with a corresponding structure on a matable connector. The latch includes a latch assembly formed of a connector housing having at least one external surface, and a cantilevered latching beam extending therefrom. The latching beam has a latching member disposed thereon for engagement with the corresponding structure of the matable connector, the latching beam being resiliently deflectable in a direction toward the housing to release the latching member from the corresponding structure. An elastomeric pressure pad is associated with the latch assembly and disposed between the latching beam and the housing to resiliently bias the latching beam into positive connection with the corresponding structure, while not interfering with normal function of the latch.

5 Claims, 1 Drawing Sheet

FIG-1
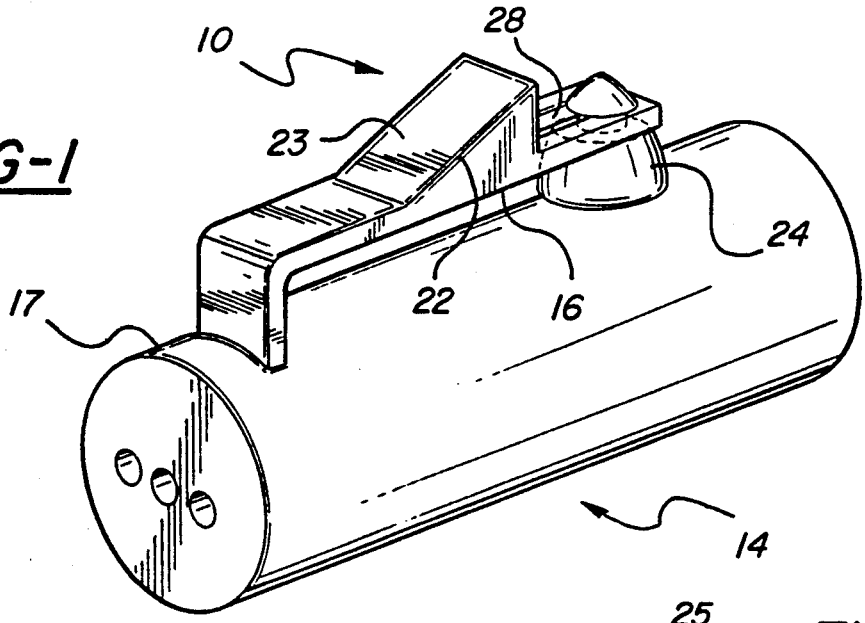
FIG-2
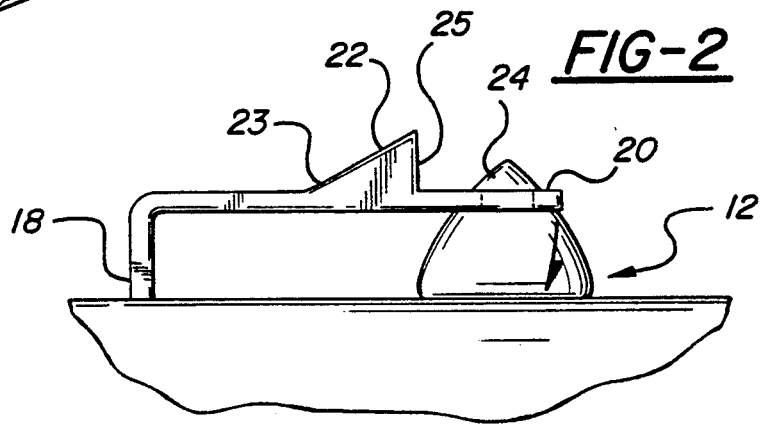
FIG-3
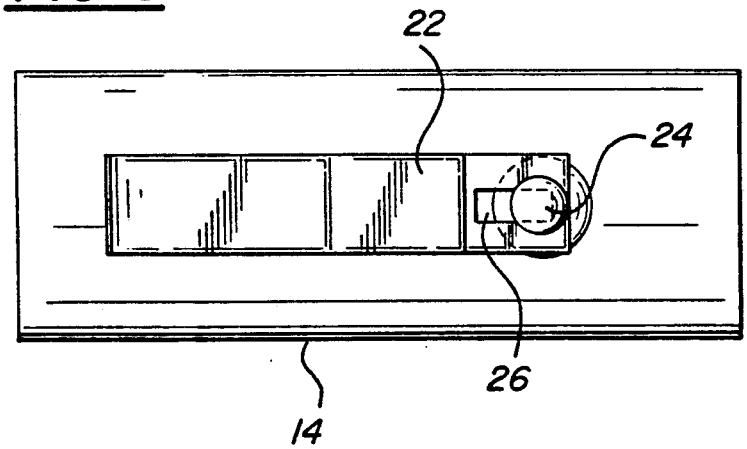
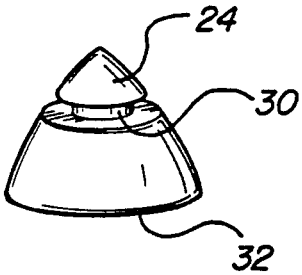
FIG-4

POSITIVE CONNECTION LATCH

FIELD OF THE INVENTION

This invention concerns electrical connectors and, more particularly, such a connector including a latch provided with an elastomeric pressure pad to positively bias one member of a pair of connectors into engagement with the other member.

BACKGROUND OF THE INVENTION

A vast number of differently designed electrical connector pairs are known in the prior art. These connector pairs, which frequently comprise a male member and female member, are used in such applications such as providing electrical connections in wiring systems, particularly vehicle wiring harnesses. To make the connection between the pairs, the male member typically is inserted into the female member. Of course, in order to prevent accidental disengagement of the members of the connector pair, means such as a latch assembly are frequently provided to keep the members of the pair in positive engagement.

A typical latch assembly employed for this purpose is a cantilevered latching beam which has one end disposed on the housing of one of the members of the connector pair, the other end terminating in a free end. Disposed on the latching beam is a latching body which is typically configured to have a ramped surface in the direction facing away from the attached end of the latching beam and a stop surface facing in the opposite direction (facing the free end). When fabricated of a resilient material such as an appropriate polymer, the latching beam may be resiliently deflected by simply pressing the free end toward the housing. Another stop surface is provided on the housing of the opposite member of the connector pair, often being disposed on a cage which is configured to receive the latching beam. As the two members are engaged by inserting the male member into the female, the latching beam is depressed so that the beam slides within the cage of the other member, the ramped surface of the latched device sliding over the stop surface disposed in the cage. As soon as the latch device slides past this stop surface, the latching beam will resiliently pop up, thus engaging the two stop surfaces to provide a positive connection. Of course, the two members may be disconnected by depressing the latching beam to disengage the stop surfaces and then sliding the beam back out of the cage. Connectors employing such a latching beam are disclosed in, for example, U.S. Pat. Nos. 5,163,848; 4,370,013; 4,986,766; 4,950,179; and 4,925,398.

However, despite the positive engagement of the two latching surfaces, accidental disengagement is not unknown between connector pairs employing the resilient latching beam described above. Because of its resiliency, the latching beam is easily deflected away from the connector housing. When the two connector pairs are subjected to opposed axial forces, the force sustained by the engaged stop surfaces is also transferred outwardly, and tends to deflect the latching finger, thus resulting in failure of the connection. This failure mechanism is described in, for example, U.S. Pat. No. 4,975,075.

Various ad hoc solutions are sometimes employed to solve this problem. For example, a wedge may be placed between the locking beam and the housing of the connector member after the two members of the connector pair have been connected. Such wedging of the locking beam holds it rigid and prevents downward displacement. However, this solution has several disadvantages: the wedge must be removed in order to disconnect the connectors, a task which may be difficult to accomplish if the wedge has been tightly inserted; conversely, if the wedge is too loose, it may simply fall out, leaving the latching beam free to deflect. Clearly, both of these results are highly undesirable. Furthermore, since the wedge must be inserted after the connectors are mated, the wedge may simply be forgotten, a not infrequent occurrence. Also inserting the wedge manually is a costly assembly step. What is needed is a means for keeping a cantilevered locking beam from accidental displacement caused by axial forces on the connector members so that the connector pair is kept in positive engagement. Such a means should be inseparable from the connection so that it cannot fall out, but should also allow the latching beam to be depressed in the normal manner.

SUMMARY OF THE INVENTION

Disclosed and claimed herein is a positive connection latch for use on one member of a pair of matable connectors for releasable engagement with a corresponding structure on the other member of the connector pair. The latch includes a latch assembly made up of a connector housing having at least one external surface and a cantilevered latching beam having a first end disposed on said housing. The latching beam terminates in a second free end and also includes a latching member disposed on the latching beam for engagement with a corresponding structure on the matable connector. The beam, which is preferably formed integral with the connector housing, is resiliently deflectable in a direction toward the housing by applying an appropriate pressure to its free end. The latching member may be released from the corresponding structure on the matable connector by applying the appropriate pressure.

The latch further includes an elastomeric pressure pad which is associated with the latch assembly and is disposed between the latching beam and the housing. In one embodiment, the pressure pad is disposed on the latching beam, and in the other embodiment it is disposed on the housing. The elastomeric pressure pad resiliently biases the beam in a direction away from the housing and into locking engagement with the corresponding structure on the matable connector. The elastomeric pressure pad is elastically deformable by applying the appropriate pressure which deflects the latching beam so that the connector may be inserted into and disconnected from its mating connector. Depending on the application to which it is put, it may extend the entire distance between the latching beam and the housing, or it may terminate short of one of those structures.

Means are provided for mounting the pressure pad to the latch assembly. In one embodiment, the latching beam further includes a slot formed therein and having a side wall. The elastomeric pressure pad has a circumferential groove formed therein for engagement with the side wall of the slot to hold the pressure pad within the slot. Although it may take many configurations, some preferred embodiments of the pressure pad include a spherical configuration having a groove formed around its circumference, and a cone shaped body having a groove circumferentially formed around its tapering surface. Preferably, the pressure pad is formed of molded rubber. The pressure pad maintains constant pressure against the latching beam to prevent accidental disconnects, but does not interfere with the normal function of the connector.

BRIEF DESCRIPTION OF THE DRAWINGS

The following detailed description is best understood by reference to the drawings, in which:

FIG. 1 is a perspective view of an electrical connector provided with the positive pressure latch of the present invention;

FIG. 2 is a partial side view of the latch of FIG. 1;

FIG. 3 is a top plan view of the connector of FIG. 1 and the latch provided thereon; and FIG. 4 depicts the pressure pad separated from the latch to better show its configuration.

DETAILED DESCRIPTION OF THE PREFERRED EMBODIMENT

Referring now to the drawings, and in particular to FIG. 1, there is shown a positive connection latch 10 according to the present invention. The latch 10 is for use on a connector 14 which is releasably engageable with a corresponding structure on a matable connector (not shown). The latch 10 includes a latch assembly 12 (best seen in FIG. 2) which, in turn, includes two major components, namely, a latching beam 16 which is disposed on the housing 17 of the connector 14. The latching beam 16 has a first end 18 which is disposed on (and preferably integral with) the housing 17 and terminates in a second, free end 20.

Formed on latching beam 16 is a latching member 22. As is typical, latching member 22 protrudes away from the upper surface of the latching beam 16 and is configured to include a sloped, ramping surface 23 which faces in a direction toward first end 18 of latching beam 16 and an opposed, vertically extending stop surface 25 which extends in a direction toward second end 20 of latching beam 16. Pressure on the latching beam 16 in the direction indicated by the arrows shown in FIGS. 1 and 2 resiliently deflects the latching beam 16 toward the housing 17 so that the connector 14 is free to move into and out of engagement with its matable connector.

The latch 10 further includes an elastomeric pressure pad 24 which is associated with the latch assembly 12 and is disposed between the latching beam 16 and the housing 17. In the embodiment depicted in the figures, the pressure pad 24 is disposed on the latching beam 16, itself. In an alternate, undepicted embodiment, the pressure pad can be disposed upon the connector housing, itself. Preferably, the pressure pad 24 is molded of natural or silicone rubber, but it is to be understood that it can be formed of any suitably elastomeric material.

Formed around the circumference of pressure pad 24 is a groove 30, best seen in FIG. 4. Groove 30 is configured for engagement with the side wall 28 of a slot 26 formed in latching beam 16. As can be seen in FIG. 3, pressure pad 24 is appropriately sized such that all but the groove 30 thereof is slightly larger than the slot 26, thus ensuring a secure fit of the pressure pad 24 into the slot 26. The pressure pad 24 depicted in FIGS. 1–4 is in the general shape of a cone having a base 32 disposed in contact with the housing 17, but it is to be understood that the base 32 may terminate short of the housing 17 so that a small gap exists therebetween. While the pressure pad is shown as a cone other shapes may be employed, such as, for example, a sphere or cylinder, in which case the groove is formed around the circumference thereof. In some instances, the pressure pad may comprise a non-grooved member which is retained in a groove or recess associated with the body 17 or beam 16 of the connector 14.

As can be readily understood, pressure pad 24 exerts a positive force on latching beam 16 in a direction away from housing 17, and counters downward deflection thereof. That is, it exerts positive pressure in a direction toward latching engagement with the corresponding structure on the matable connector. Thus, pressure pad 24 helps preserve the integrity of the connection by counteracting any accidental downward forces exerted on latching beam 16. However, and unlike prior art ad hoc wedges, pressure pad 24 is elastically deformable, and, thus, does not interfere with the function of the connectors. That is, the exertion of appropriate pressure upon the latching beam causes pressure pad 24 to compress, thus permitting normal downward deflection of the latching beam so that the connector pad may be disengaged in the normal manner. Thus, the positive connection latch of the present invention is both secure, and easy to operate.

Of course, the latch of the present invention is useful upon a variety of types of matable connectors other than the one depicted. Furthermore, the relative position of the ramped latch member and the pressure pad may be somewhat different from that depicted; for example, the latching member may actually overlie the pressure pad, or it may be displaced outwardly from the pressure pad toward the free end of the latching beam. Furthermore, the latching member may have a somewhat different configuration than that depicted. Such variations in design are considered to be within the skill of the routineer having the benefits of the teaching of the present invention. Thus, the present invention is not limited to the exemplifications and embodiments depicted herein, but solely by the claims appended hereto.

I claim:

1. A positive connector latch assembly for releasable engagement with a corresponding structure on a matable connector, said latch assembly comprising:

a connector housing having at least one external surface; and a cantilevered latching beam having a first end disposed on said housing and terminating in a second, free end and having a latching member disposed thereon for engagement with said corresponding structure on said matable connector, said beam being resiliently deflectable in a direction toward said housing by applying an appropriate pressure to said free end to release said latching member from said corresponding structure;

an elastomeric pressure pad associated with said latch assembly and disposed between said beam and said housing to resiliently bias said beam in a direction away from said housing and into locking engagement with said corresponding structure, said elastomeric pressure pad being elastically deformable by said appropriate pressure; and means for mounting said pad to said latch assembly.

2. The latch assembly of claim 1 wherein said pad is disposed on said latching beam.

3. The latch assembly of claim 2 wherein said mounting means comprises a slot having a side wall formed in said beam, said pad further including a groove configured for engagement with the slot side wall.

4. The latch assembly of claim 3 wherein the pad is configured generally as a cone having a base extending toward said housing.

5. The latch assembly of claim 1 wherein the latching member includes a ramped surface facing in a direction toward the first end of the latching beam and an opposed stop surface facing in a direction toward said second end thereof.

* * * * *